US011122859B2

(12) United States Patent
Lee

(10) Patent No.: US 11,122,859 B2
(45) Date of Patent: Sep. 21, 2021

(54) BOUNCING SHOE-HOLDER

(71) Applicant: UPRIGHT MANUFACTURERS (SHENZHEN) LTD., Shenzhen (CN)

(72) Inventor: Hung-Chia Lee, Shenzhen (CN)

(73) Assignee: UPRIGHT MANUFACTURING (SHENZHEN) LTD., Shenzhen (CN)

( * ) Notice: Subject to any disclaimer, the term of this patent is extended or adjusted under 35 U.S.C. 154(b) by 144 days.

(21) Appl. No.: 16/543,643

(22) Filed: Aug. 19, 2019

(65) Prior Publication Data

US 2021/0022442 A1 Jan. 28, 2021

(30) Foreign Application Priority Data

Jul. 23, 2019 (CN) ..... 201910664514.X
Jul. 23, 2019 (CN) ..... 201921165868.1

(51) Int. Cl.
*A43B 13/18* (2006.01)
*A43B 3/26* (2006.01)
*A63B 25/10* (2006.01)

(52) U.S. Cl.
CPC ..... *A43B 13/184* (2013.01); *A43B 3/26* (2013.01); *A63B 25/10* (2013.01)

(58) Field of Classification Search
CPC ..... A63B 25/00–10; A63B 5/00–22; A63G 13/06; A63G 13/08; A43B 13/184; A43B 13/183; A43B 3/001; A43B 3/26
USPC ..... 472/103, 135; 36/7.8
See application file for complete search history.

(56) References Cited

U.S. PATENT DOCUMENTS 898,084 A * 9/1908 Backermann ..... A43B 5/18 36/7.8
3,377,722 A * 4/1968 Downing ..... A63B 25/10 36/7.8
4,492,374 A * 1/1985 Lekhtman ..... A63B 25/10 267/28
5,205,798 A * 4/1993 Lekhtman ..... A43B 13/18 482/121
5,643,148 A * 7/1997 Naville ..... A43B 13/183 482/124
5,871,298 A * 2/1999 Lekhtman ..... A43B 13/184 402/77
5,916,071 A * 6/1999 Lee ..... A43B 13/182 482/77
6,318,001 B1 * 11/2001 Lee ..... A43B 13/184 36/27
6,436,012 B1 * 8/2002 Naville ..... A43B 5/00 36/114

(Continued)

FOREIGN PATENT DOCUMENTS

WO WO-2008111806 A1 * 9/2008 ..... A63B 25/10

*Primary Examiner* — Jennifer Robertson
*Assistant Examiner* — Catrina A Letterman
(74) *Attorney, Agent, or Firm* — Raymond Y. Chan; David and Raymond Patent Firm

(57) ABSTRACT

A bouncing shoe-holder includes a shoe holder for holding a shoe worn by a user, a bouncing unit and a fastening unit. The bouncing unit includes an upper resilient member having a downward curving configuration and a lower resilient member having an upward curving configuration coupled thereto in an end-to-end manner to define a bouncing cavity therebetween. The fastening unit includes a fastening member supported within the bouncing cavity to directly fasten the bouncing unit at a bottom side of the shoe holder.

13 Claims, 8 Drawing Sheets

(56) References Cited

U.S. PATENT DOCUMENTS

| | | | | |
|---|---|---|---|---|
| 6,712,395 | B1 * | 3/2004 | Lee | A43B 5/1633 280/11.19 |
| 6,722,670 | B1 * | 4/2004 | Lee | A43B 5/1658 280/11.19 |
| 2009/0056168 | A1 * | 3/2009 | Tseng | A43B 13/183 36/100 |
| 2014/0349818 | A1 * | 11/2014 | Green | A63B 5/11 482/77 |

* cited by examiner

BOUNCING SHOE-HOLDER

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to recreational and training equipments, and more particularly to a bouncing shoe-holder, which provides a safe and effective tool for muscular development and allows freedom of movement.

Description of Related Arts

Jumping shoes or bound shoes are well known and have been considered as a form of recreation, and exercise, wherein the user is able to wear the jumping shoes with bare feet for muscular development. Particularly, the jumping shoes are used as a training tool for activities, such as running, jogging, dancing, and aerobics.

U.S. Pat. No. 6,318,001, Lee, disclosed a springy sports shoe comprising a boot having a sole fastened to a springy body by a fastening body. The springy body is provided in an underside of the boot with a skidproof body fastened thereto such that the skidproof body makes contact on the ground at the time when the springy sports shoe is in action. The fastening body comprises an upper body, a lower body, and a receiving space located between said upper body and the lower body. The upper body is fastened to the sole of the boot by a plurality of fastening bolts. The lower body is fastened to the springy body by a plurality of fastened bolts. The springy body is provided with an elastic body of an elastic plastic material whereby the elastic body is provided with two insertion bars for retaining a cushioning body. However, the springy sports shoe as disclosed by Lee has the following unsolved drawbacks.

Like other sports shoes, each style of shoes is required to provide various sizes to fit all users, generally from size 5 to size 12. Even though Lee's springy sports shoes also provide all different sizes, the springy sports shoes are not like the regular dress shoes or sports shoes which are simply for walking or running. The springy sports shoes are for jumping and bouncing that requires the boot perfectly fits the size of the user's foot to avoid injury to the user. However, since the size of the boot is fixed, the user is not able to adjust the size of the boot to fit his or her feet. Users must be very careful while wearing and using the springy sports shoes to avoid accidental injury or twisting of his or her feet. Sever ankle sprain may cause serious bruising and tenderness around the ankle. In addition, when the kid grows up, the feet may not fit into the springy sports shoes. Some parents may purchase a bigger size of the springy sports shoe to provide extra room for the kid's feet to grow. Since the springy sports shoe must be worn tightly and fittedly to protect the ankle of the user during the exercise, the extra room of the springy sports shoe will allow the unwanted foot movement therewithin. As a result, the young user can easily sprain his or her ankle during the exercise.

The boot and the springy body are connected via the fastening body. Particularly, the upper portion of the fastening body is fastened to the boot and the lower portion of the fastening body is fastened to the springy body. In other words, the size or the height of the fastening body will increase the distance between a force exerting point at the boot and a force bounding point at the springy body. When increasing such distance, the bouncing force at the springy body will be unevenly exerted back to the user. As a result, the user will easily lose his or her balance and sprain his or her ankle during the exercise.

The springy body is provided between the two longitudinal ends thereof with an elastic body which is made of an elastic plastic material and is provided in the longitudinal ends thereof with a covering shell for covering both longitudinal ends of the springy body. Since the springy body is made of elastic plastic, the springy body is deformed to generate the bouncing force by the foot exerting force. The springy body is easily broken when the springy body cannot withstand the foot exerting force. However, there is no safety device to protect the user when the springy body is broken. In fact, the springy sports shoe as disclosed by Lee does not provide any safety device to indicate and protect the use of the springy sports shoe.

SUMMARY OF THE PRESENT INVENTION

The invention is advantageous in that it provides a bouncing shoe-holder, which provides a safe and effective tool for muscular development and allows freedom of movement.

Another advantage of the invention is to provide a bouncing shoe-holder, which comprises a shoe holder adapted to fittingly and detachably hold the shoe of the user, such that the user is able to wear his or her own shoes to use the bouncing shoe-holder.

Another advantage of the invention is to provide a bouncing shoe-holder, wherein the shoe holder is directly coupled at the bouncing unit to minimize the distance between a force exerting point at the shoe holder and a force bounding point at the bouncing unit so as to provide a balanced bouncing force to the shoe holder.

Another advantage of the invention is to provide a bouncing shoe-holder, which comprises a safety device coupled at the bouncing unit to indicate the use of the bouncing shoe-holder without interfering the operation of the bouncing shoe-holder.

Another advantage of the invention is to provide a bouncing shoe-holder, wherein the safety unit further provides a device for preventing the over-bending of the bouncing unit for reinforcing the strength of the bouncing unit to prevent the bouncing unit from being suddenly collapsed.

Another advantage of the invention is to provide a bouncing shoe-holder, which comprises a light indicator activated in response to a movement of the shoe holder for generating a light effect to enhance a visibility of the bouncing shoe-holder for safety purpose.

Another advantage of the invention is to provide a bouncing shoe-holder, wherein no expensive or complicated structure is required to employ in the present invention in order to achieve the above mentioned objects. Therefore, the present invention successfully provides an economic and efficient solution not only for providing a simple configuration for the user to play with the bouncing shoe-holder but also for providing safety operation to protect the user during the use of the bouncing shoe-holder.

Additional advantages and features of the invention will become apparent from the description which follows, and may be realized by means of the instrumentalities and combinations particular point out in the appended claims.

According to the present invention, the foregoing and other objects and advantages are attained by a bouncing shoe-holder, comprising:

a shoe holder having a bottom side and a shoe cavity for securely holding a shoe worn by a user;

a bouncing unit comprising an upper resilient member and a lower resilient member coupled with the upper resilient member in an end-to-end manner to define a bouncing cavity therebetween, wherein the bouncing cavity has an oval shape; and a fastening unit which comprises a fastening member supported within the bouncing cavity to directly fasten the bouncing unit at the bottom side of the shoe holder.

In accordance with another aspect of the invention, the present invention comprises a bouncing shoe-holder, comprising:

a shoe holder having a bottom side and a shoe cavity for securely holding a shoe worn by a user;

a bouncing unit comprising an upper resilient member having a downward curving configuration and a lower resilient member having an upward curving configuration coupled thereto in an end-to-end manner to define a bouncing cavity therebetween, wherein the bouncing unit is directly coupled at the bottom side of the shoe holder; and a safety unit which comprises a light indicator supported within the bouncing cavity, wherein the light indicator is activated in response to a movement of the shoe holder for generating a light effect to enhance a visibility of the bouncing shoe-holder.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
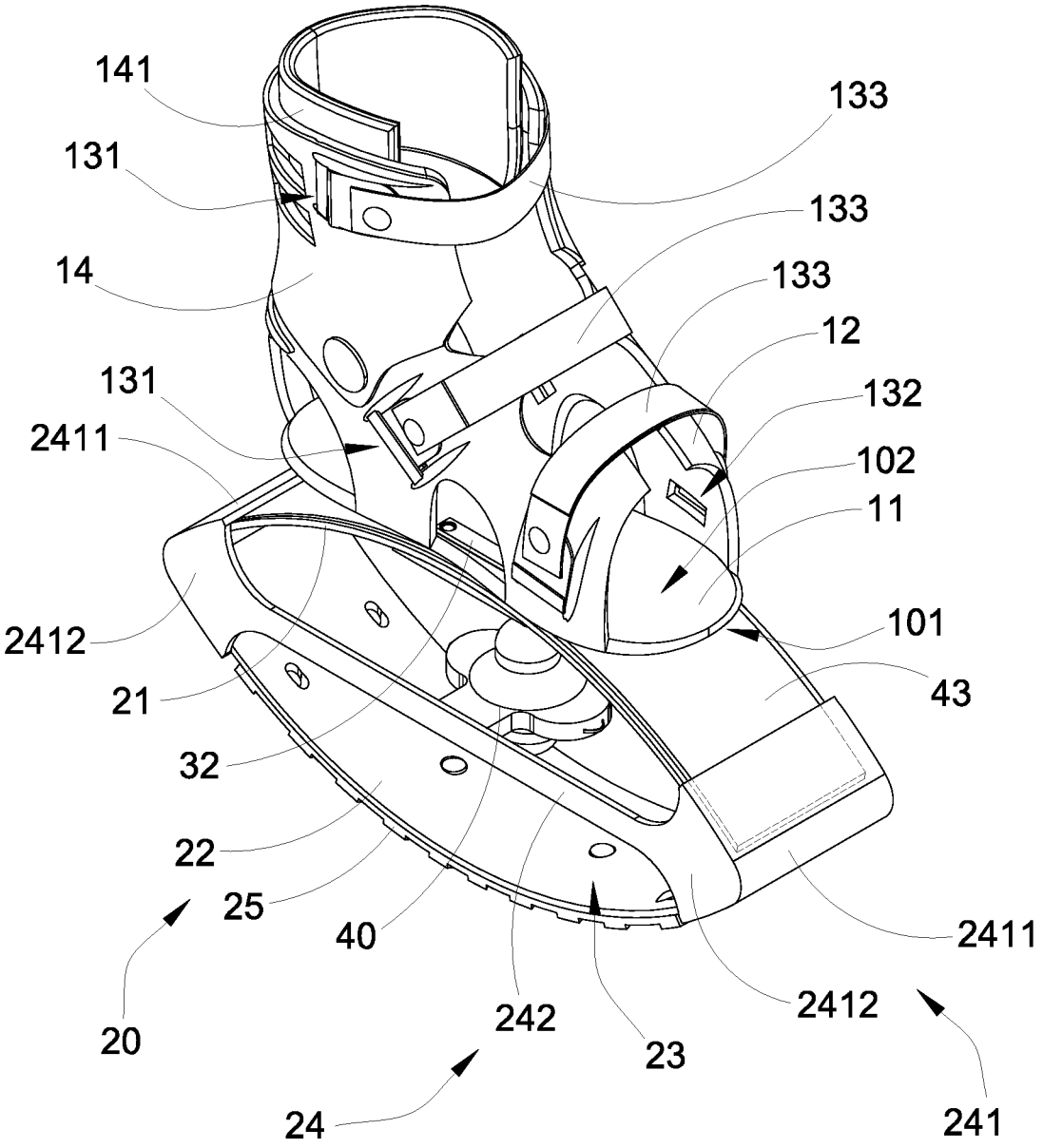
FIG. 1 is a perspective view of a bouncing shoe-holder according to a preferred embodiment of the present invention.

Referring to FIG. 1 of the drawings, a bouncing shoe-holder according to a preferred embodiment of the present invention is illustrated, wherein the bouncing shoe-holder comprises a shoe holder 10, a bouncing unit 20, a fastening unit 30, and a safety unit 40.

As shown in FIGS. 1 to 4, the shoe holder 10 has having a bottom side 101 and a shoe cavity 102 for securely holding a shoe worn by a user. In other words, the user is able to wear his or her own shoe to use the bouncing shoe-holder, such that different sizes of the shoes can be securely held in the shoe cavity 102 to enhance the practice use of the bounding shoe-holder.

In one embodiment, the bouncing unit 20 comprises an upper resilient member 21 and a lower resilient member 22 coupled with the upper resilient member 21 in an end-to-end manner to define a bouncing cavity 23 therebetween. Accordingly, the upper resilient member 21 has a downward curving configuration and the lower resilient member has an upward curving configuration, such that when the upper and lower resilient members 21, 22 are coupled end-to-end, the bouncing cavity 23 is formed with an oval shape. The bouncing unit 20 is arranged to generate a bouncing force by reciprocatingly pressing the upper and lower resilient members 21, 22 toward each other and rebounding the upper and lower resilient members 21, 22 away from each other.

The fastening unit 30 is arranged for directly coupling the bottom side 101 of the shoe holder 10 at the bouncing unit 20 to minimize a distance between a force exerting point at the shoe holder 10 and a force bounding point at the bouncing unit 20 so as to provide a balanced bouncing force to the shoe holder 10. Accordingly, after securing the shoes of the user at the pair of bouncing shoe-holders respectively, the user is able to jump or walk to apply a downward force to the bouncing unit 20, such that the bouncing force is generated by the bouncing unit 20 to the user.

Figure 4:
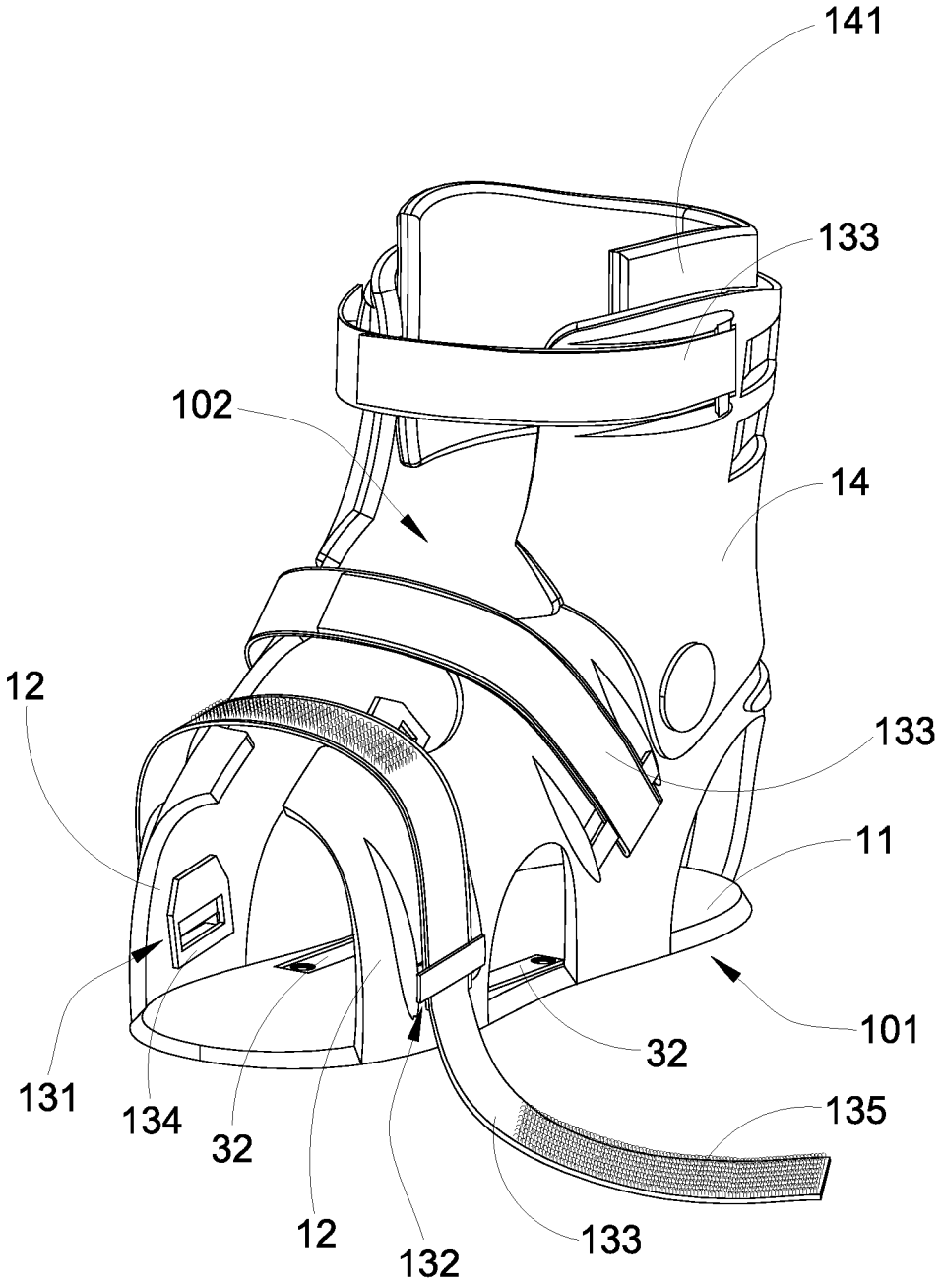
FIG. 4 is a perspective view of a shoe holder of the bouncing shoe-holder according to the above preferred embodiment of the present invention.

As shown in FIG. 4, the shoe holder 10 comprises a base platform 11, two vamp covers 12 upwardly extended from two sides of the base platform 11 respectively to define the shoe cavity 102, and a shoe tightening unit 13 coupled between the vamp covers 12 to selectively adjust a size of the shoe cavity 102 for tightly fitting the shoe therein. Accordingly, each shoe of the user can be rested and supported on the respective base platform 11 and wrapped by the vamp covers 12 to retain the shoe within the shoe cavity 102. The size of the shoe cavity 102 can be selectively adjusted by the distance between the vamp covers 12 to fit different sizes of shoes. Preferably, the shoe holder 10 further has an anti-skip structure, such as grid structure or an anti-skip layer, formed on the top side of the base platform 11 to prevent any unwanted movement of the shoe with respect to the base platform 11.

The shoe holder 10 further comprises an ankle cover 14 integrally and upwardly extended from the vamp covers 12 respectively for tightly wrapping around an ankle of the user. It is worth mentioning that the ankle cover 14 cannot be moved or folded with respect to the vamp covers 12. Therefore, the ankle of the user can be secured and held by the ankle cover 14 to prevent the ankle sprain during the use of the bouncing shoe-holder. Preferably, an ankle cushioning element 141 is provided at an inner side of the ankle cover 14 to provide a soft and cushion effect for the user when the ankle of the user is wrapped by the ankle cover 14.

According to the preferred embodiment, the shoe tightening unit 13 comprises first and second coupling slots 131, 132 formed at the vamp covers 12 respectively, an elongated fastening strap 133 extended through the first and second coupling slots 131, 132, and an anchoring element 134 provided at a fixed end of the fastening strap 133.

The first and second coupling slots 131, 132 are two elongated slots formed at the vamp covers 12, wherein each of the first and second coupling slots 131, 132 has a predetermined width for enabling the fastening strap 133 slidably passing through. The anchoring element 134 is bigger than the size of the first coupling slot 131 to retain the fixed end of the fastening strap 133 at the first coupling slot 131.

Figure 5:
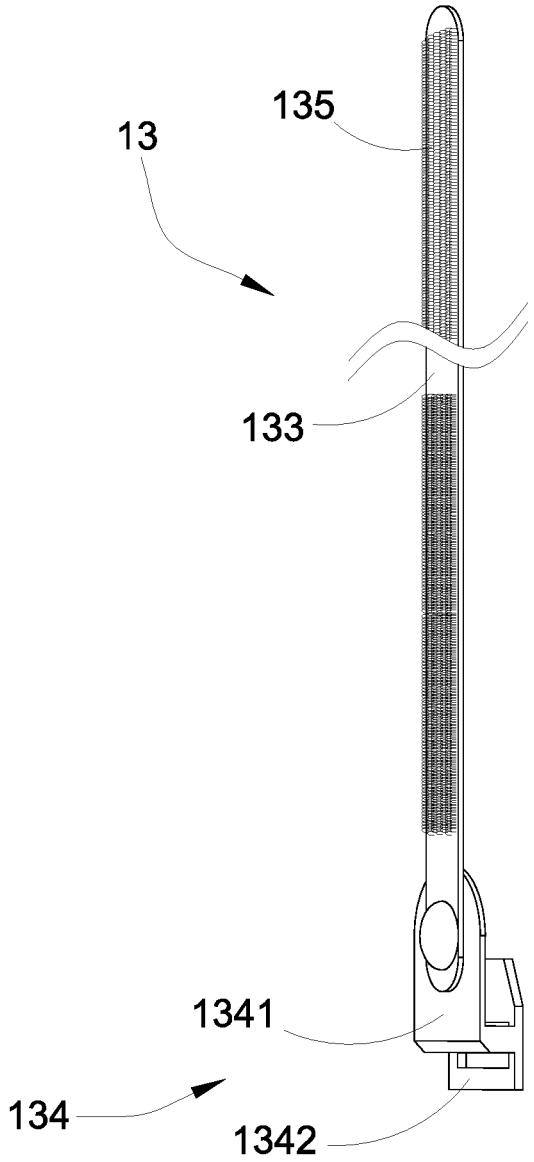
FIG. 5 is a perspective view of an anchoring element of the bouncing shoe-holder according to the above preferred embodiment of the present invention.
Figure 6:
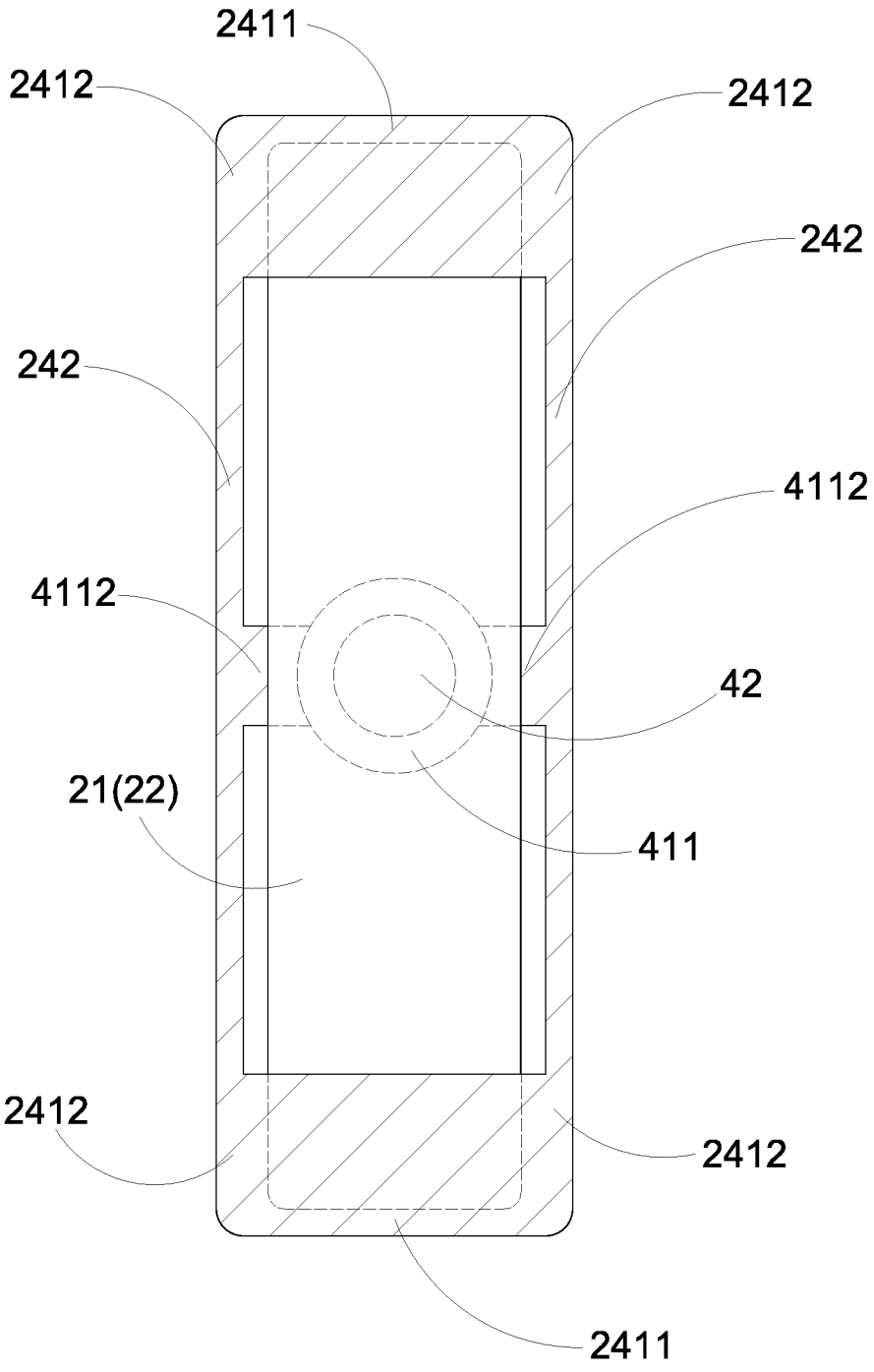
FIG. 6 is a top view of a bouncing unit of the bouncing shoe-holder according to the above preferred embodiment of the present invention.

As shown in FIG. 5, the anchoring element 134 comprises an angled member 1341 and an anchor member 1342. The angled member 1341, preferably having a L-shape, has two ends that one end of the angled member 1341 is coupled at the fixed end of the fastening strap 133 while another end of the angled member 1341 is coupled at the anchor member 1342. Particularly, the angled member 1341 comprises a strap connector portion coupled at the fixed end of the fastening strap 133 and an extension portion perpendicularly extended from the strap connector to form the L-shaped configuration of the angled member 1341. The extension portion of the angled member 1341 is integrally extended to a mid-portion of the anchor member 1342, such that the strap connector portion of the angled member 1341 is parallel to the anchor member 1342. In order to retain the fixed end of the fastening strap 133, the anchoring element 134 is coupled at the corresponding vamp cover 12 through the first coupling slots 131 at a position that the strap connector portion of the angled member 1341 and the anchor member 1342 are located at the outer and inner sides of the vamp cover 12 respectively while the extension portion of the angled member 1341 is extended between the strap connector portion of the angled member 1341 and the anchor member 1342 through the first coupling slot 131. In other words, the fastening strap 133 passes through the first coupling slot 131 from the inner side of the corresponding vamp cover 12 to the outer side thereof until the anchor member 1342 of the anchoring element 134 bias against the inner side of the vamp cover 12. The fixed end of the fastening strap 133 is retained at the corresponding vamp cover 12. When an opposed free end of the fastening strap 133 is extended through the second coupling slot 132 to adjustably fasten back at the fastening strap 133, the size of the shoe cavity 102 is selectively adjusted. In other words, after the free end of the fastening strap 133 is extended through the second coupling slot 132, the sliding out portion of the fastening strap 133 is folded to overlap on the extending portion of the fastening strap 133 to form a loop of the fastening strap 133. The sliding out portion of the fastening strap 133 is a portion extending from the free end and passing out of the second coupling slot 131 and the extending portion of the fastening strap 133 is a portion extending from the fixed end and forming between the first and second coupling slots 131, 132.

Furthermore, the shoe tightening unit 13 further comprises a hook and loop fastener 135 provided along the fastening strap 133 to allow the free end of the fastening strap 133 being self-fastened thereat. Preferably, the hook and loop fastener 135 is provided along the sliding out portion and the extending portion of the fastening strap 133, such that after the free end of the fastening strap 133 passes through the second coupling slot 132, the free end of the fastening strap 133 is folded to overlap thereon via the hook and loop fastener 135 to securely and adjustably retain the distance between the vamp covers 12. It is worth mentioning that the user is able to wear different shoes to be retained by the shoe holder 10. For example, the user's shoe has a wider toe portion can be held by the vamp covers 12 and tightened by the adjustment of the fastening strap 133. It is worth mentioning that multiple fastening straps 133 can be used for the shoe holder 10. In one embodiment, three fastening straps 133 are used such that two fastening straps 133 are spacedly provided at the front and rear portions of the vamp covers 12 and the third fastening strap 133 is provided at the ankle cover 14. In other words, three sets of first and second coupling slots 131, 132 are provided correspondingly at the vamp covers 12 and the ankle cover 14.

As shown in FIGS. 1 to 3 and 6, each of the upper and lower resilient members 21, 22 generally has a rectangular shape and is preferably made of plastic, wherein two transverse edges of the upper resilient member 21 are coupled at two transverse edges of the lower resilient member 22 respectively to form the bouncing cavity 23 with the oval shape or eye shape.

The bouncing unit 20 further comprises a resilient holder 24 holding the upper and lower resilient members 21, 22 in position to retain the shape of the bouncing cavity 23. Accordingly, the resilient holder 24 comprises two end retainers 241 each retaining two corresponding end portions of the upper and lower resilient members 21, 22, and two resilient arms 242 parallely and integrally extended between the end retainers 241 to retain a distance therebetween.

Accordingly, each of the end retainers 241 comprises an end cover 2411, having a V-shaped configuration, and two sidewalls 2412 integrally formed at two sides of the end cover 2411 to define an end cavity within the end cover 2411 and the sidewalls 2412, wherein the end portions of the upper and lower resilient members 21, 22 are received in the end cavity of each of the end retainers 241. It is worth mentioning that each of the upper and lower resilient members 21, 22 is bent in a curving configuration to receive the end portions thereof within the end retainers 241. Preferably, the resilient arms 242 are integrally extended between the sidewalls 2412 of the end retainers 241, wherein each of the resilient arms 242 is extended from one sidewall 2142 of the end retainer 241 to the sidewall 2142 of another end retainer 241. Therefore, via the two resilient arms 242, the distance between the end retainers 241 is held to retain the upper and lower resilient members 21, 22 in the curving configuration.

Figure 2:
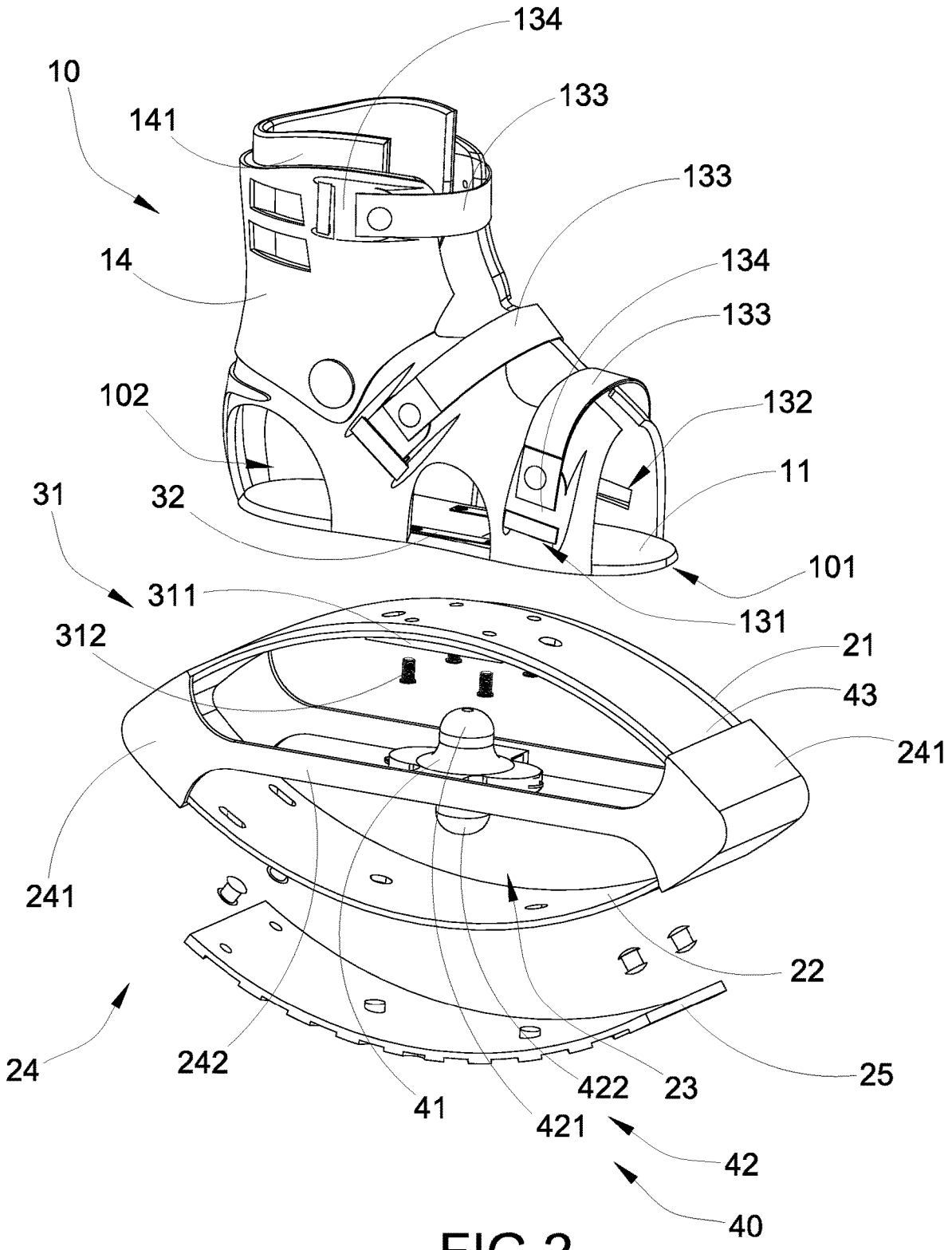
FIG. 2 is an exploded perspective view of the bouncing shoe-holder according to the above preferred embodiment of the present invention.
Figure 3:
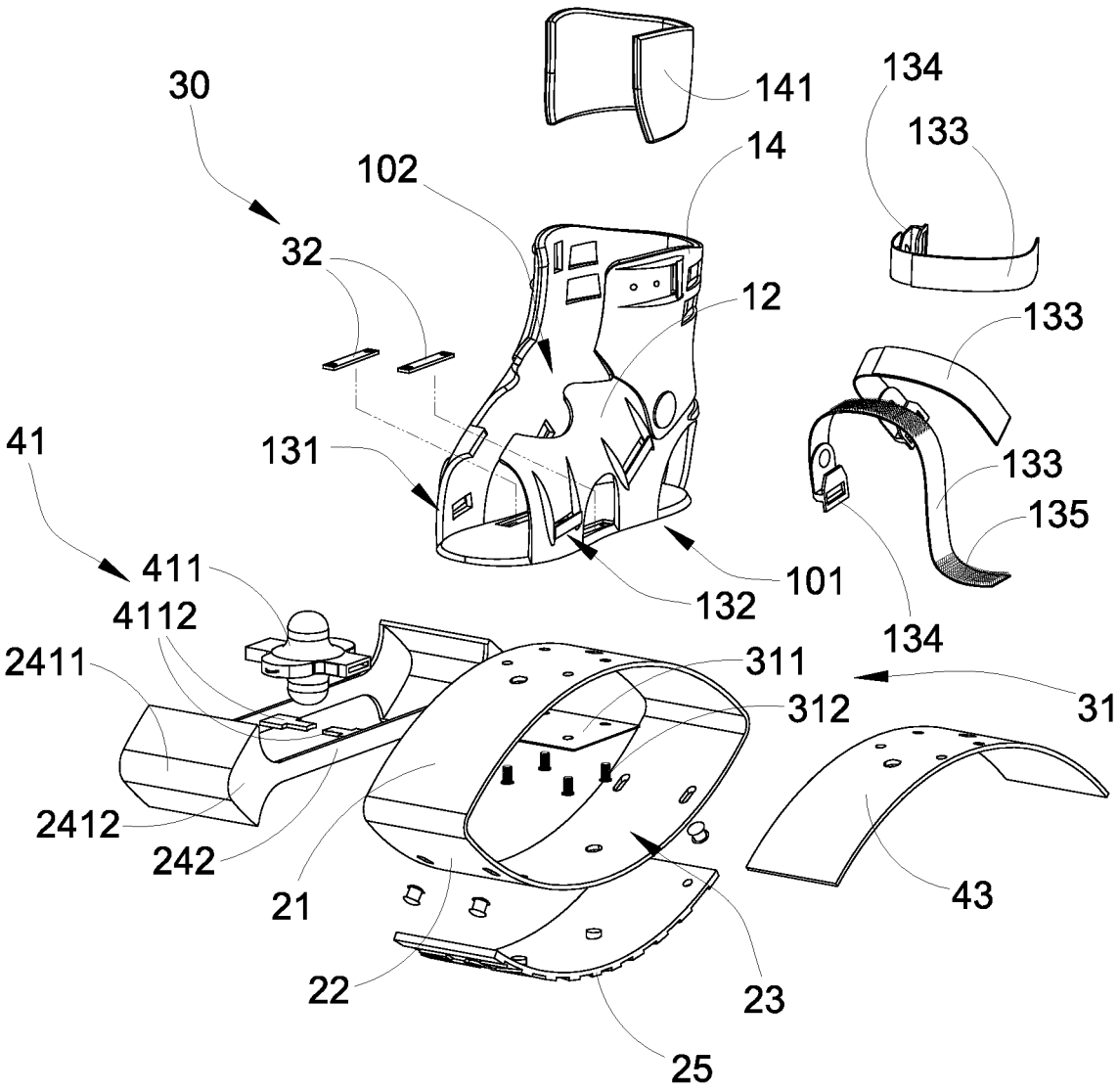
FIG. 3 is an exploded perspective view of a fastening unit and bouncing unit of the bouncing shoe-holder according to the above preferred embodiment of the present invention.

As shown in FIGS. 1 to 3, the bouncing unit 20 further comprises an anti-skip member 25 coupled at a bottom side of the lower resilient member 22. Accordingly, the anti-skip member 25 has a curvature matching with the curvature of the lower resilient member 22. The anti-skip member 25 is able to reinforce the strength of the lower resilient member 22 to prevent the over-bending thereof and to prevent the lower resilient member 22 from being suddenly collapsed.

As shown in FIGS. 1 to 3, the fastening unit 30 comprises a fastening member 31 supported within the bouncing cavity 23 to directly fasten the bouncing unit 20 at the bottom side 101 of the shoe holder 10. Accordingly, the fastening member 31 is coupled at an underside of the upper resilient member 21 and extended therethrough to directly fasten at the bottom side 101 of the shoe holder 10.

According to the preferred embodiment, the fastening unit 30 further comprises a coupling member 32 disposed in the shoe cavity 102 of the shoe holder 10 to couple with the fastening member 31 so as to couple the shoe holder 10 at the bouncing unit 20. Preferably, the coupling member 32 is indented in a bottom wall of the shoe cavity 102, i.e. the top side of the base platform 11, to detachably couple with the fastening member 31. In other words, the base platform 11 has an indented cavity formed at the top side thereof to receive the coupling member 32 in the indented cavity, such that the coupling member 32 will not protruded from the top side of the base platform 11. Therefore, the bottom side 101 of the shoe holder 10 is directly contacted and coupled to the top side of the upper resilient member 21 of the bouncing unit 20.

In one embodiment, the fastening member 31 comprises a fastening panel 311 overlapped at the underside of the upper resilient member 21 and at least one fastening bolt 312 coupled at the fastening panel 311 and extended through the upper resilient member 21 to couple with the coupling member 32. In order to couple the shoe holder 10 at the bouncing unit 20, the user is able to rotate the fastening bolt 312 at the fastening panel 311 to penetrate through a screw hole of the upper resilient member 21 and a screw hole of the base platform 11 of the shoe holder 10 so as to couple the fastening bolt 312 to the coupling member 32. In other words, the shoe holder 10 can be detached from the bouncing unit 20 by unscrewing the fastening bolt 312 from the coupling member 32.

The safety unit 40 comprises a light indicator 41 supported within the bouncing cavity 23 of the bouncing unit 20, wherein the light indicator 41 is activated in response to a movement of the shoe holder 10 for generating a light effect to enhance a visibility of the bouncing shoe-holder.

As shown in FIGS. 1-3 and 7, the light indicator 41 is detachably coupled at the bouncing unit 20 via the resilient arms 242. The light indicator 41 comprises a light casing 411 detachably coupled between the resilient arms 242, a power source 412 received in the light casing 411, a light source 413 powered by the power source 412 for generating the light effect, and a motion sensor 414 detecting the movement of the shoe holder 10 to activate the light source 413.

Figure 7:
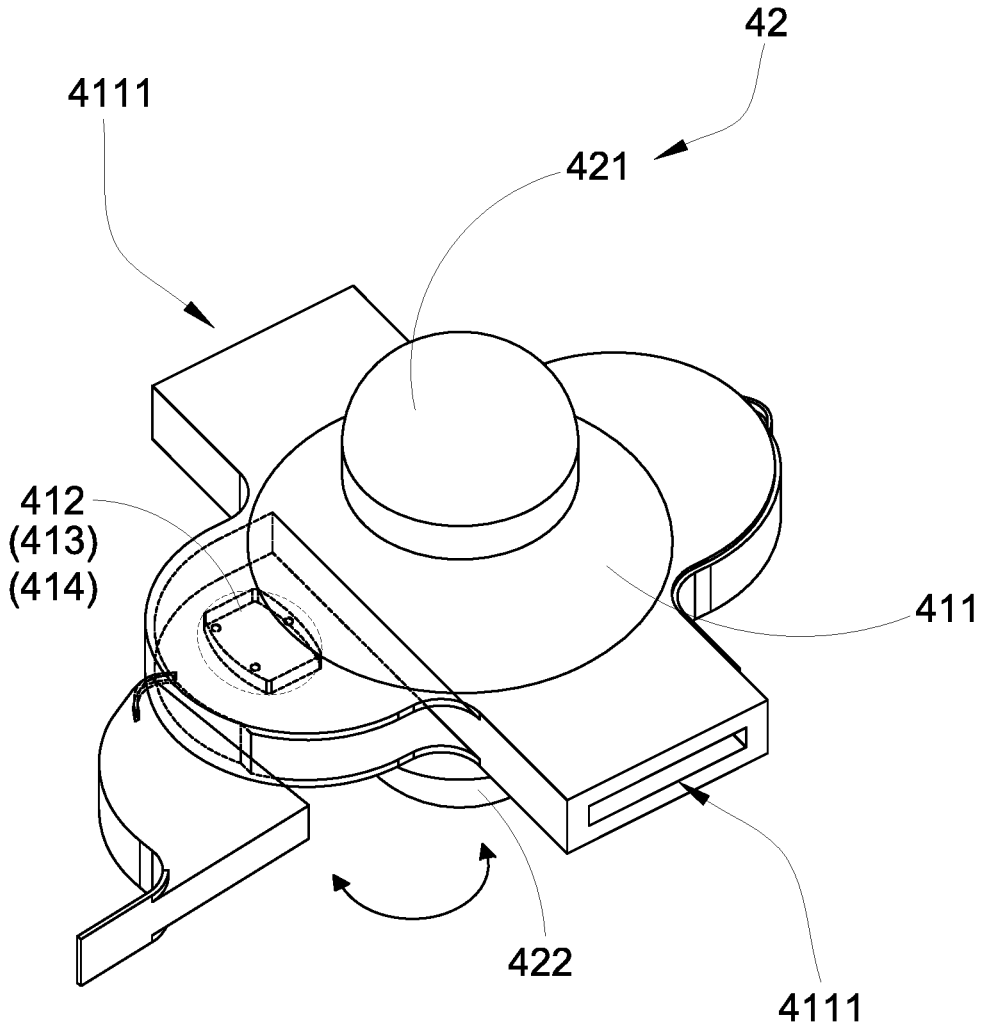
FIG. 7 is a perspective view of a light indicator of the bouncing shoe-holder according to the above preferred embodiment of the present invention.

The light casing 411 can be made of durable but light weight material. Preferably, the light casing 411 is made of transparent or translucent material adapted for the light passing through. Accordingly, the light casing 411 has two side slots 4111, wherein two inserting arms 4112 are extended from the resilient arms 242 to slidably insert into the side slots 4111 respectively so as to support the light indicator 41 within the bouncing cavity 23 of the bouncing unit 20. Preferably, the inserting arms 4112 are integrally extended from the resilient arms 242 and are alignedly extended toward each other to detachably engage with the light casing 411. As shown in FIG. 7, the light casing 411 further has a sealing cavity for receiving the power source 412 and the light source 413 therein, and a foldable door detachably coupling at an opening of the sealing cavity to seal the power source 412 and the light source 413 in the sealing cavity.

The power source 412 is embodied as a battery compartment for receiving a replaceable battery therein to electrically connect to the light source 413 and the motion sensor 414. Preferably, the light source 413 comprises one or more diodes connected to the power source 412 for generating the light effect, such as flashing effect or color chancing effect. The motion sensor 414 is built-in with the light source 413 to form a single indicator module received and protected within the light casing 411. Accordingly, when the user uses the bouncing shoe-holder of the present invention, the motion sensor 414 will detect the movement of the user via the shoe holder 10, such that the light source 413 is activated to generate the light effect for the visibility of the bouncing shoe-holder. In one embodiment, two indicator modules, i.e. two power sources 412, two light sources 413 and two motion sensors 414, are spacedly received in two sealing cavities of the light casing 411 and two foldable doors are detachably sealed at the openings of the sealing cavities.

The safety unit 40 further comprises an over-bend limiter 42 for preventing each of the upper and lower resilient members 21, 22 from being over-bent. The over-bend limiter 42 is supported within the bouncing cavity 23 to limit the distance between the upper and lower resilient members 21, 22 when the upper and lower resilient members 21, 22 are bent toward each other. Accordingly, the over-bend limiter 42 comprises an upper stopper 421 upwardly extended from the light casing 411 toward the underside of the upper resilient member 21 and a lower stopper 422 downwardly extended from the light casing 411 toward the top side of the lower resilient member 22. When the upper and lower resilient members 21, 22 are bent toward each other via the downward pressing force of the shoe holder 10, the free end of the upper stopper 421 will bias against the underside of the upper resilient member 21 and the free end of the lower stopper 422 will bias against the top side of the lower resilient member 22. The upper and lower stoppers 421, 422 will prevent the upper and lower resilient members 21, 22 being bent from the curving configuration to the flat configuration. In other words, the distance between the free ends of the upper and lower stoppers 421, 422 will limit the upper and lower resilient members 21, 22 being bent and closed to each other so as to prevent the over-bending of the upper and lower resilient members 21, 22 due to the excessive downward pressing force from the user. Preferably, the upper and lower stoppers 421, 422 are made of shock absorbing material and are integrally formed with the light casing 411. When the light indicator 41 is supported within the bouncing cavity 23, the upper and lower stoppers 421, 422 are aligned at a center of the bouncing cavity 23.

Accordingly, the upper and lower stoppers 421, 422 are opposedly extended at a mid-portion of the light casing 411 at the vertical direction of the light casing 411, wherein the side slots 4111 are alignedly extended along the horizontal-transverse direction of the light casing 411 and the sealing cavities are alignedly formed along the horizontal-longitudinal direction of the light casing 411.

According to the modification, the safety unit 40 further comprises a reinforcing member 43 provided at the upper resilient member 21 to prevent the upper resilient member 21 suddenly collapsed. When an excessive downward force is applied to the upper resilient member 21, the curving configuration of the upper resilient member 21 is bent that may cause the upper resilient member 21 suddenly collapsing. The reinforcing member 43 will reinforce the strength of the upper resilient member 21 to prevent the over-bending thereof and to prevent the upper resilient member 21 from being suddenly collapsed. In one embodiment, the reinforcing member 43 is made of resilient material such as metal plate and is coupled at the top side of the upper resilient member 21. For example, the reinforcing member 43 can be a metal plate overlapped and attached on the top side and/or underside of the upper resilient member 21. It is appreciated that the reinforcing member 43 can be a boundary frame coupled at a peripheral edge of the upper resilient member 21. Alternatively, the reinforcing member 43 can be a metal rim attached to two longitudinal edges of the upper resilient member 21. The reinforcing member 43 can be embedded in the upper resilient member 21 at the time when the upper resilient member 21 is made during the manufacturing process thereof.

Figure 8:
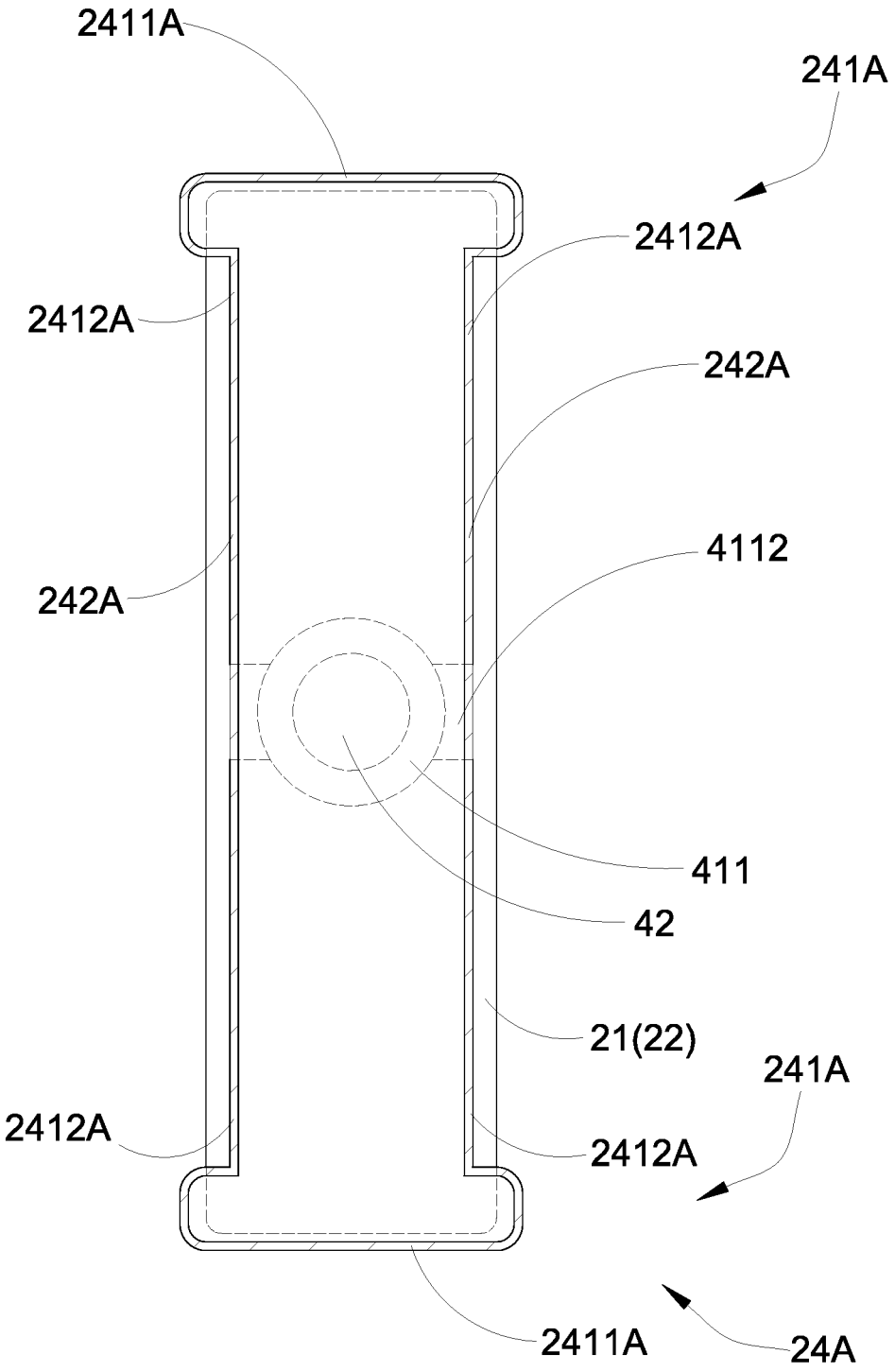
FIG. 8 illustrates an alternative mode of the bouncing unit of the bouncing shoe-holder according to the above preferred embodiment of the present invention.

FIG. 8 illustrates a modification of the resilient holder 24A holding the upper and lower resilient members 21, 22 in position to retain the shape of the bouncing cavity 23. Accordingly, the resilient holder 24A comprises two end retainers 241A each retaining two corresponding end portions of the upper and lower resilient members 21, 22, and two resilient arms 242A parallely and integrally extended between the end retainers 241A to retain a distance therebetween.

Each of the end retainers 241A comprises an end cover 2411A, having a V-shaped configuration, and two sidewalls 2412A integrally formed at two sides of the end cover 2411A to define an end cavity within the end cover 2411A and the sidewalls 2412A, wherein the end portions of the upper and lower resilient members 21, 22 are received in the end cavity of each of the end retainers 241A.

As shown in FIG. 8, the two sidewalls 2412A are indented formed at two sides of the end cover 2411A, such that the sidewalls 2412A are disposed within the bouncing cavity 23. The resilient arms 242A are integrally extended between the sidewalls 2412A of the end retainers 241A, wherein each of the resilient arms 242A is extended from one sidewall 2142A of the end retainer 241A to the sidewall 2142A of another end retainer 241A. In other words, the resilient arms 242A are extended within the bouncing cavity 23 to retain the distance between the end retainers 241A. Comparing to FIG. 6, a distance between the resilient arms 242 is slightly larger than a width of each of the upper and lower resilient members 21, 22. As shown in FIG. 8, a distance between the resilient arms 242A is smaller than a width of each of the upper and lower resilient members 21, 22. Therefore, no protrusion is formed at the side of the bouncing shoe-holder to prevent the user being tripped by any side protrusion of the bouncing shoe-holder.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A bouncing shoe-holder, comprising:

a shoe holder, having a bottom side and a shoe cavity, adapted for securely holding a shoe worn by a user, wherein said shoe holder comprises a base platform, two vamp covers upwardly extended from two sides of said base platform respectively to define said shoe cavity, and a shoe tightening unit coupled between said vamp covers to selectively adjust a size of said shoe cavity for tightly fitting the shoe of the user therein, wherein said shoe tightening unit comprises first and second coupling slots formed at said two vamp covers respectively, an elongated fastening strap extended through said first and second coupling slots, and an anchoring element provided at a fixed end of said fastening strap and configured to retain said fixed end of said fastening strap at said first coupling slot, such that when an opposed free end of said fastening strap is extended through said second coupling slot to adjustably fasten at said fastening strap, the size of said shoe cavity is selectively adjusted;

a bouncing unit comprising an upper resilient member having a downward curving configuration and a lower resilient member having an upward curving configuration coupled thereto in an end-to-end manner to define a bouncing cavity therebetween; and a fastening unit which comprises a fastening member supported within said bouncing cavity to directly fasten said bouncing unit at said bottom side of said shoe holder.

2. The bouncing shoe-holder, as recited in claim 1, wherein said shoe tightening unit further comprises a hook and loop fastener provided along said fastening strap to allow said free end of said fastening strap to be self-fastened thereat.

3. The bouncing shoe-holder, as recited in claim 2, wherein said shoe holder further comprises an ankle cover integrally and upwardly extended from said vamp covers respectively for tightly wrapping around an ankle of the user.

4. A bouncing shoe-holder, comprising:

a shoe holder, having a bottom side and a shoe cavity, adapted for securely holding a shoe worn by a user;

a bouncing unit comprising an upper resilient member having a downward curving configuration and a lower resilient member having an upward curving configuration coupled thereto in an end-to-end manner to define a bouncing cavity therebetween, wherein said bouncing unit is directly coupled at said bottom side of said shoe holder; and a safety unit which comprises a light indicator supported within said bouncing cavity, wherein said light indicator is activated in response to a movement of said shoe holder for generating a light effect to enhance a visibility of the bouncing shoe-holder.

5. The bouncing shoe-holder, as recited in claim 4, wherein said bouncing unit further comprises a resilient holder holding said upper and lower resilient members, wherein said resilient holder comprises two end retainers each retaining two corresponding end portions of said upper and lower resilient members, and two resilient arms parallely and integrally extended between said end retainers to retain a distance therebetween.

6. The bouncing shoe-holder, as recited in claim 5, wherein each of said end retainers has two sidewalls indented in said bouncing cavity such that said resilient arms are integrally extended from said sidewalls of each of said end retainers respectively, such that said resilient arms are extended within said bouncing cavity.

7. The bouncing shoe-holder, as recited in claim 5, wherein said light indicator is detachably coupled between said resilient arms to retain said light indicator within said bouncing cavity.

8. The bouncing shoe-holder, as recited in claim 4, wherein said light indicator comprises a power source, a light source powered by said power source for generating the light effect, and a motion sensor detecting the movement of said shoe holder to activate said light source.

9. The bouncing shoe-holder, as recited in claim 4, wherein said shoe holder comprises a base platform, two vamp covers upwardly extended from two sides of said base platform respectively to define said shoe cavity, and a shoe tightening unit coupled between said vamp covers to selectively adjust a size of said shoe cavity for tightly fitting the shoe therein.

10. The bouncing shoe-holder, as recited in claim 9, wherein said shoe tightening unit comprises first and second coupling slots formed at said vamp covers respectively, an elongated fastening strap extended through said first and second coupling slots, and an anchoring element provided at a fixed end of said fastening strap to retain said fixed end of said fastening strap at said first coupling slot, such that when an opposed free end of said fastening strap extends through said second coupling slot to adjustably fasten at said fastening strap, the size of said shoe cavity is selectively adjusted.

11. The bouncing shoe-holder, as recited in claim 4, further comprising a fastening unit that couples said shoe holder at said bouncing unit, wherein said fastening unit comprises a fastening member supported within said bouncing cavity to directly fasten said bouncing unit at said bottom side of said shoe holder, a coupling member indented in a bottom wall of said shoe cavity and configured to couple with said fastening member, a fastening panel overlapped at an underside of said upper resilient member, and at least one fastening bolt coupled at said fastening panel and extended through said upper resilient member to couple with said coupling member.

12. The bouncing shoe-holder, as recited in claim 4, wherein said bouncing unit further comprises a reinforcing member provided at said upper resilient member to prevent said upper resilient member from suddenly collapsing.

13. The bouncing shoe-holder, as recited in claim 4, wherein said bouncing unit further comprises an anti-skip member coupled at a bottom side of said lower resilient member.

* * * * *